United States Patent [19]

Guarino et al.

[11] 4,225,343

[45] Sep. 30, 1980

[54] ADDITION AGENT FOR MOLTEN METALS

[75] Inventors: Giovanni Guarino, Acilia; Alberto Praitoni, Pomezia, both of Italy

[73] Assignee: Centro Sperimentale Metallurgico S.p.A., Rome, Italy

[21] Appl. No.: 32,474

[22] Filed: Apr. 23, 1979

[30] Foreign Application Priority Data

Apr. 21, 1978 [IT] Italy ..... 49007 A/78

[51] Int. Cl.[2] ..... C22C 33/08

[52] U.S. Cl. ..... 75/130 R; 75/53; 75/58

[58] Field of Search ..... 75/53, 58, 130 R

[56] References Cited

U.S. PATENT DOCUMENTS

| | | | |
|---|---|---|---|
| 3,656,989 | 4/1972 | Layland | 75/53 |
| 3,953,198 | 4/1976 | Easwaran | 75/53 |
| 3,969,105 | 7/1976 | Ott | 75/53 |
| 4,083,716 | 4/1978 | Yoshida | 75/53 |

*Primary Examiner*—P. D. Rosenberg

*Attorney, Agent, or Firm*—Young & Thompson

[57] ABSTRACT

An addition agent for the inoculation of a molten metal bath consists essentially of 50 to 90% by weight of a metal selected from the group consisting of alkali metal and alkaline earth metal having a particle size greater than 3 mm. but no more than 10 mm., 5 to 49% by weight of an inert porous material selected from the group consisting of semi-coke, coke, coke breeze and graphite, the porous material having a particle size greater than 3 mm. but no more than 20 mm., and 1 to 10% by weight of a binder which secures the metal particles and porous material particles together in a briquette, and can be coal pitch, coal bitumen, petroleum pitch, petroleum asphalt, or phenolic or furanic resin.

4 Claims, 1 Drawing Figure

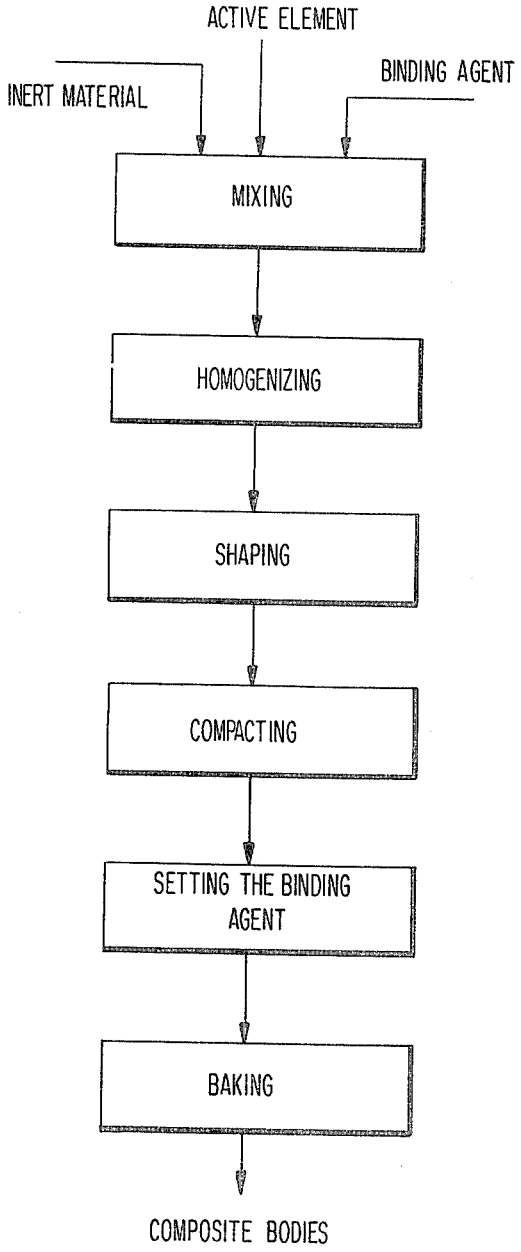
ACTIVE ELEMENT
INERT MATERIAL
BINDING AGENT
MIXING
HOMOGENIZING
SHAPING
COMPACTING
SETTING THE BINDING AGENT
BAKING
COMPOSITE BODIES

ADDITION AGENT FOR MOLTEN METALS

The present invention relates to composite bodies containing reactive metals, to be added to metal baths, the composite bodies being supported by porous physically inert substances which are suitably chemically inert to the conditions of use.

The invention is an improvement on that of U.S. Pat. No. 3,918,963, Nov. 11, 1975. Compared to the invention of that earlier patent, the present invention provides composite bodies with superior mechanical and chemical properties, suitable for use not only for desulfurizing pig iron baths, but also for steel deoxidation and desulfuriztion and for controlling the type and size of inclusions trapped in steel in all portions of the steelmaking plants, for example, in continuous casting tundishes.

That earlier patent dealt with the problem of adding to metal baths, metallic elements which were highly volatile and/or easily oxidizable and/or violently reactive in the bath. The problem was solved in that earlier patent, by preparing a mixture of active metal powder and powdered inert support material, homogenizing the mixture, dry compacting and briquetting the mixture with the aid of an appropriate binder in order to form briquettes, heating the briquettes to activate the setting properties of the binder, and, if necessary, baking the briquettes.

More particularly, the earlier patent provided a composition of the following weight percent:

active metal: 5–50%
inert material: 50–80%
binder: 10–25%

The material was homogenized and briquetted, that is, shaped and compacted, at a temperature between 80° C. and 130° C. Then the briquettes were heated to a temperature between 150° C. and 250° C. for 15 to 90 minutes. If necessary, the briquettes were subsequently baked at a temperature between 250° C. and 900° C.

The active metal, in the earlier patent as in the present invention, could be an alkali metal or an alkaline earth metal, or, more generally, any metal which was to be added to the bath and which was highly volatile and/or easily oxidizable and/or strongly reactive with the bath. The metal in the earlier patent was in powdered form and had a grain size between 0.1 and 3 mm.

The inert material, there as here, could be coke, coke breeze, semi-coke or graphite, or, more generally, any substance or compound having the required porosity and mechanical strength. The grain size of the inert material ranged from 0.1 to 3 mm. in the earlier patent.

The binders of the earlier patent could be coal pitch, coal bitumen, petroleum pitch, petroleum asphalt or a mixture thereof. The active metal and inert material and binder were then homogenized at a temperature not higher than 50° C. above the softening point of the binder.

According to the present invention, quite unexpectedly, it has been found that the technical results previously obtained are improved by the present invention, by altering not only the proportions of the material, but more importantly their particle size. Thus, according to the present invention, addition agents in the form of composite bodies having superior mechanical and chemical properties as compared to those produced by the above-identified patent, consist essentially of more than 50% but not more than 90% of a metal selected from the group consisting of alkali metal and alkaline earth metal having a particle size greater than 3 mm. but not more than 10 mm., 5 to 49% by weight of a porous material having a particle size greater than 3 mm. but not more than 20 mm. and selected from the group consisting of semi-coke, coke, coke breeze and graphite, and 1 to 10% by weight of a binder which secures the metal particles and porous material particles together in a compact, which can be referred to as a briquette. The binder can be coal pitch, coal bitumen, petroleum pitch, petroleum asphalt or a mixture thereof, or a phenolic or furanic resin.

The product thus obtained can be baked in an oxidizing, reducing or neutral atmosphere (independently or after briquetting at a temperature between 80° C. and 250° C.) for less than 24 hours at a temperature higher than 250° C. up to the melting point of the active substances included in the mixture. The active substances themselves can for example be sodium, magnesium, calcium, lithium, potassium, rubidium, cesium, beryllium, strontium or barium or a mixture thereof, or a compound of such active elements which is easily reduced by the support materials, such as oxides or chlorides.

To facilitate the release of alkali and/or alkaline earth elements from such compounds, elements having a high affinity for oxygen, such as aluminum or silicon, can be included in the mixture in quantities not greater than 20% by weight.

The present invention, as compared to the addition agent of the earlier patent, has increased resistance to disintegration under the static load of the overlying head of molten metal. This makes the skeleton support which is extracted from the bath after consumption of the metallic components thereof, dimensionally unaltered even when the overlying head of molten metal is several inches deep or more.

Furthermore, an addition agent according to the present invention releases the active elements at a very slow rate with a corresponding increase in the efficiency of the active elements.

The invention is further illustrated in the accompanying drawing, which is a flow diagram of a method according to the invention.

To enable those skilled in the art to practice the invention, the following illustrative examples are given:

EXAMPLE 1

A mixture consisting of 9% by weight pitch, 40% by weight coke breeze having a particle size range greater than 3 mm. but no more than 5 mm., and 51% by weight of particulate magnesium having a size range greater than 3 mm. but not greater than 10 mm., was heated at 90° C. and compacted in small batches under a pressure of 500 Kg/cm$^2$. These small compacted masses were then immersed in a pig iron bath contained in a 100 ton torpedo car in the proportion of 0.5 Kg of compacted material per ton of pig iron. The entire magnesium content of the immersed composites was released in the space of five minutes. The sulfur content of the pig iron bath was initially 0.024% by weight but was reduced to 0.010% by weight by this treatment. The magnesium yield was 50%.

EXAMPLE 2

The same mixture was heated for several hours at 350° C. and then used in a torpedo car as described in Example 1. The sulfur content of the bath was initially 0.032% by weight, but fell to 0.014% by weight as a result of the treatment described in Example 1. Again, the magnesium yield was 50%.

EXAMPLE 3

Example 2 was repeated, but in connection with a bath whose initial sulfur content was 0.022%. The final sulfur content was 0.002%; and the magnesium yield was 60%.

EXAMPLE 4

Example 1 was repeated, except that, instead of 51% by weight of magnesium particles, 25% by weight of calcium and 26% by weight of magnesium was used, the composition and granulometry being otherwise the same as in Example 1. Comparable desulfurization and magnesium and calcium yield results were obtained.

EXAMPLE 5

The composite material of Example 4 was pretreated at 350° C. for several hours and was used, in the proportion of 500 g of desulfurizing agent per ton of molten steel, for desulfurizing a steel bath in the ladle. The initial sulfur content of the bath was 0.020% which was reduced to 0.010%. The magnesium and calcium yield was 50%.

EXAMPLE 6

Example 5 was repeated, except that 5% by weight pitch, 40% by weight coke breeze, 25% by weight sodium chloride and 30% by weight magnesium was used. The initial sulfur content of the bath was 0.025% by weight, which fell to 0.012% by weight. The yield of the sodium chloridemagnesium system was 70%, which is the sum of that which is consumed in the course of desulfurization plus the magnesium that is retained in the steel, the balance joining the slag as various salts.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. An addition agent for the inoculation of a molten metal bath, consisting essentially of more than 50% but not more than 90% by weight of a metal selected from the group consisting of alkali metal and alkaline earth metal, said metal having a particle size greater than 3 mm. but not more than 10 mm., 5 to 49% by weight of a porous material having a particle size greater than 3 mm. but not more than 20 mm., said porous material being selected from the group consisting of semi-coke, coke breeze, coke and graphite, and at least 1% but less than 10% by weight of a binder which secures said metal particles and said porous material particles together in a briquette, said metal and said porous material each being in the form of discrete particles which are separate from each other but which are held together by said binder.

2. An agent as claimed in claim 1, in which said selected metal is magnesium.

3. An agent as claimed in claim 1, in which said binder is selected from the group consisting of coal tar, coal tar pitch, petroleum pitch, petroleum bitumen, and synthetic resin.

4. An agent as claimed in claim 1, in which said metal is selected from the group consisting of sodium, magnesium, calcium, lithium, potassium, rubidium, cesium, beryllium, strontium and barium.

* * * * *